US007752963B1

(12) United States Patent
Niswonger

(10) Patent No.: US 7,752,963 B1
(45) Date of Patent: Jul. 13, 2010

(54) APPARATUS AND METHOD FOR SCREEN TENSIONING

(76) Inventor: John O. H. Niswonger, 24980 Paseo Primario, Calabasas, CA (US) 91302

( * ) Notice: Subject to any disclaimer, the term of this patent is extended or adjusted under 35 U.S.C. 154(b) by 444 days.

(21) Appl. No.: 11/827,729

(22) Filed: Jul. 13, 2007

Related U.S. Application Data

(60) Provisional application No. 60/830,712, filed on Jul. 13, 2006.

(51) Int. Cl.
*B05C 17/06* (2006.01)

(52) U.S. Cl. ..... 101/127.1; 160/378; 38/102.5; 38/102.91

(58) Field of Classification Search ..... 101/127, 101/127.1; 38/102.1, 102.5, 102.7, 102.91, 38/102.3; 160/378, 379, 380, 381
See application file for complete search history.

(56) References Cited

U.S. PATENT DOCUMENTS 3,601,912 A * 8/1971 Dubbs ..... 38/102.91
3,805,873 A * 4/1974 Bloomfield ..... 160/392
3,962,805 A 6/1976 Hamu
3,982,306 A * 9/1976 Curry ..... 24/462
4,186,660 A 2/1980 Key
4,338,860 A 7/1982 Hamu
4,345,390 A 8/1982 Newman
4,409,749 A * 10/1983 Hamu ..... 38/102.3
4,539,734 A * 9/1985 Messerschmitt ..... 24/460
4,694,746 A 9/1987 Hamu
4,860,467 A 8/1989 Larson
4,893,406 A 1/1990 Larson
5,018,442 A 5/1991 Hamu
5,096,524 A 3/1992 Ohtani et al.
5,097,761 A 3/1992 Hamu
5,127,176 A 7/1992 Newman
5,148,745 A 9/1992 Hamu
5,163,367 A 11/1992 Newman
5,265,534 A 11/1993 Hamu
5,275,098 A 1/1994 Larson
5,379,691 A 1/1995 Hamu et al.
5,443,003 A 8/1995 Larson
5,503,068 A 4/1996 Newman
5,648,189 A 7/1997 Newman
5,771,801 A 6/1998 Newman et al.
5,802,971 A 9/1998 Hamu et al.
5,806,422 A 9/1998 Hamu
5,806,425 A 9/1998 Newman et al.
5,813,328 A 9/1998 Hamu
5,832,822 A 11/1998 Hamu
5,974,962 A 11/1999 Hamu et al.
5,988,059 A 11/1999 Hamu
6,070,526 A 6/2000 Larson
6,098,538 A 8/2000 Hamu
6,318,255 B1 11/2001 Larson
6,505,552 B1 1/2003 Larson (Continued)

*Primary Examiner*—Ren Yan
(74) *Attorney, Agent, or Firm*—Ronald L. Rohde

(57) ABSTRACT

A screen fabric frame is disclosed including a locking strip and a frame member. The frame member includes a locking strip groove extending at least a portion of a length of the frame member. The locking strip groove includes a central groove configured to receive the locking strip, a minor side groove having a minor depth, and a major side groove distal the central groove, the major side groove having a major depth greater than minor depth of the minor side groove.

17 Claims, 8 Drawing Sheets

U.S. PATENT DOCUMENTS

| | | | | |
|---|---|---|---|---|
| 6,736,057 | B1 | 5/2004 | Larson | |
| D524,365 | S | 7/2006 | Hamu | |
| D549,567 | S | 8/2007 | Hamu | |
| 7,497,159 | B2 * | 3/2009 | Kasuya | 101/127.1 |
| 2002/0139258 | A1 | 10/2002 | Hamu | |
| 2004/0079245 | A1 | 4/2004 | Larson | |
| 2005/0268800 | A1 | 12/2005 | Hamu | |
| 2006/0010728 | A1 | 1/2006 | Larson | |
| 2006/0010730 | A1 | 1/2006 | Larson | |
| 2007/0000160 | A1 | 1/2007 | Larson | |
| 2008/0235999 | A1 | 10/2008 | Larson | |
| 2008/0236418 | A1 | 10/2008 | Larson | |

* cited by examiner

APPARATUS AND METHOD FOR SCREEN TENSIONING

CROSS-REFERENCE TO RELATED APPLICATIONS

The application claims the benefit of U.S. Provisional Patent Application No. 60/830,712 entitled "Improved Apparatus and Method for Screen Tensioning," filed on Jul. 13, 2006 which is incorporated herein by reference in its entirety.

FIELD OF THE APPLICATION

The present application relates generally to a silkscreen apparatus, and more particularly to silkscreen fabric tensioning.

DESCRIPTION OF RELATED ART

Generally, a screen tensioning and printing frame is capable of handling fabrics across the wide range of weight and texture. One method is to use a roller including a longitudinal groove and a locking strip to secure the fabric into the groove. The fabric is pushed into the groove. The locking strip is inserted into the groove from an end of the groove and pushed or pulled lengthwise through the groove to secure the fabric. The locking strip is extracted from the groove by sliding it the length of the groove out one end of the groove to release the fabric. Often the groove is the length of the roller. Unfortunately, it is difficult to work the locking strip along the length of the groove and the locking strip catches on the fabric during insertion and removal. What is needed is a method of easily inserting and removing a locking strip into a groove to secure fabric in the groove.

SUMMARY

The present disclosure includes a screen fabric frame comprising a locking strip and a frame member. The frame member includes a locking strip groove extending at least a portion of a length of the frame member. The locking strip groove includes a central groove configured to receive the locking strip, a minor side groove having a minor depth, and a major side groove distal the central groove, the major side groove having a major depth greater than the minor depth of the minor side groove. The locking strip groove may be in the shape of a "T".

In some embodiments, a screen fabric tensioning member includes a locking strip groove cross section comprising a central portion configured to receive a screen fabric and a locking strip. The locking strip groove cross section further comprises a minor side groove having a minor depth and configured to bind the screen fabric between the minor side groove and the locking strip and a major side groove having a major depth greater than the minor depth.

In some embodiments, a method of tensioning a screen fabric includes inserting the screen fabric into a longitudinal groove in a screen tensioning member and inserting a first edge of a locking strip into the groove, the screen fabric disposed between the locking strip and the groove. The method further includes pushing the screen fabric into a major side groove having a major depth using the first edge of the locking strip, rotating the locking strip to an orientation about parallel with a base of the groove, applying tension to the screen configured to urge a second edge of the locking strip into a minor side groove having a minor depth less than the major depth, and binding the screen fabric between the second edge of the locking strip and the minor side groove. In some embodiments, the method further includes applying the tension to the screen fabric by rotating the screen tensioning member. In some embodiments, the method further includes removing the screen fabric from the longitudinal groove in the screen tensioning member by applying a counter tension to the screen fabric in a direction about opposite the tension.

DETAILED DESCRIPTION

In the following description, numerous specific details are set forth to provide a more thorough understanding of the present invention. However, it will be apparent to a person having ordinary skill in the art that the present invention may be practiced without one or more of these specific details. In other instances, well-known features have not been described in order to avoid obscuring the present invention.

Figure 1:
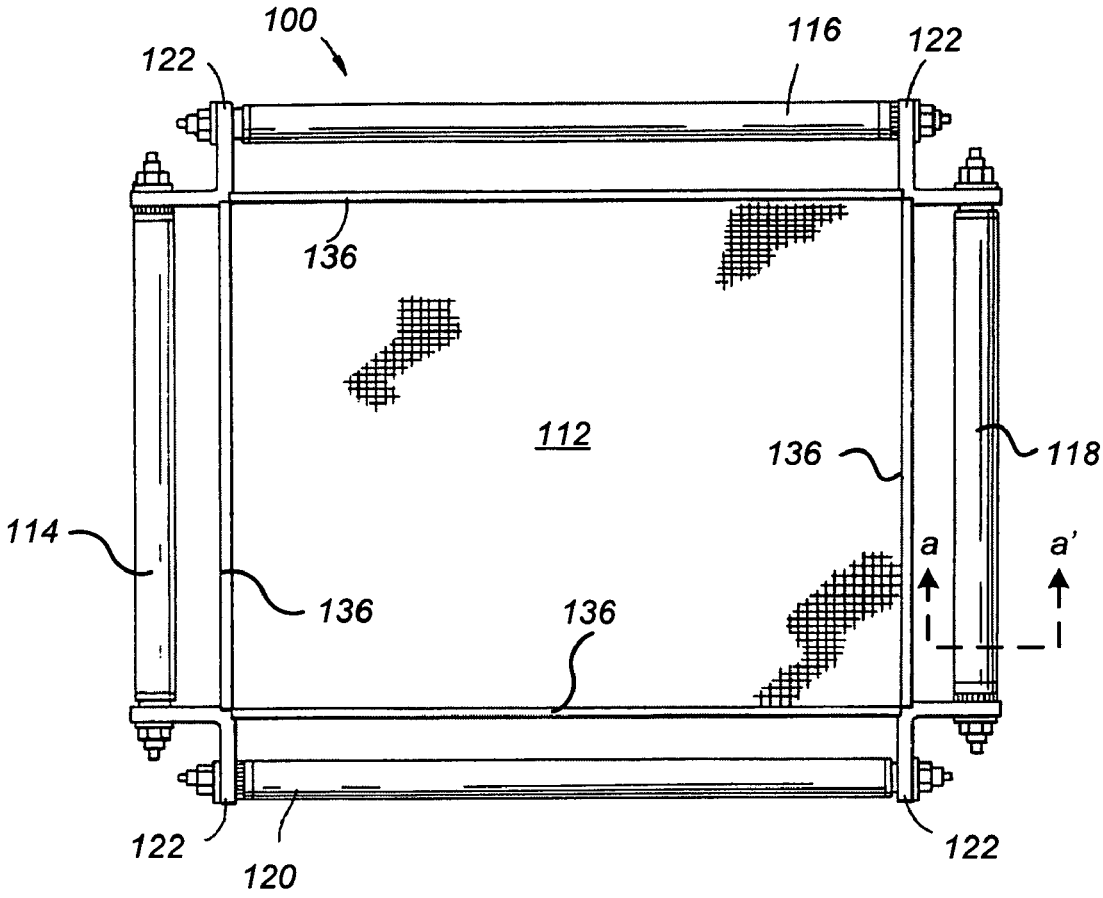
FIG. 1 is a top plan view of one embodiment of a screen tensioning and printing frame, in accordance with aspects of the invention.

FIG. 1 is a top plan view of one embodiment of a screen tensioning and printing frame generally designated 100, in accordance with aspects of the invention. A screen fabric 112 may be applied to one face of the frame. The frame 100 includes a plurality of frame members designated 114 and 118 which may be about parallel to each other and frame members 116 and 120 which may be about parallel to each other. Frame members 114 and 118 may be about mutually perpendicular with respect to frame members 116 and 120. In some embodiments, the frame members 114, 116, 118 and 120 (hereinafter 114-120) may be rotatably supported at their respective ends by a plurality of corner members 122.

In some embodiments, the frame members 114-120 may be hollow frame members made from a light weight, non-corrosive material such as aluminum, steel, plastic, and/or the like. The plurality of corner members 122 are rigid members and may be made from a lightweight non-corrosive material such as aluminum, steel, plastic, and/or the like. The plurality of corner members 122 may be supported by a frame assembly 136.

In some embodiments, one or more frame members 114-120 may be secured in a predetermined rotative position so that a desired tension may be applied to a screen fabric 112.

The tension may be applied to the screen fabric 112 by a ration of one or more of the frame members 114-120. The frame members 114-120 may be rotated individually or in various combinations to apply tension to the screen fabric 112, as is well understood by persons skilled in the art.

In some embodiments, one or more frame members 114-120 may be secured in a predetermined translational position such that a desired tension may be applied to a screen fabric 112. The tension may be applied to the screen fabric 112 by a translation of the frame members 114-120 in about the plane of the frame 100. The frame members 114-120 may be translated individually or in various combinations to apply tension to the screen fabric 112, as is well understood by persons having ordinary skill in the art.

Figure 2:
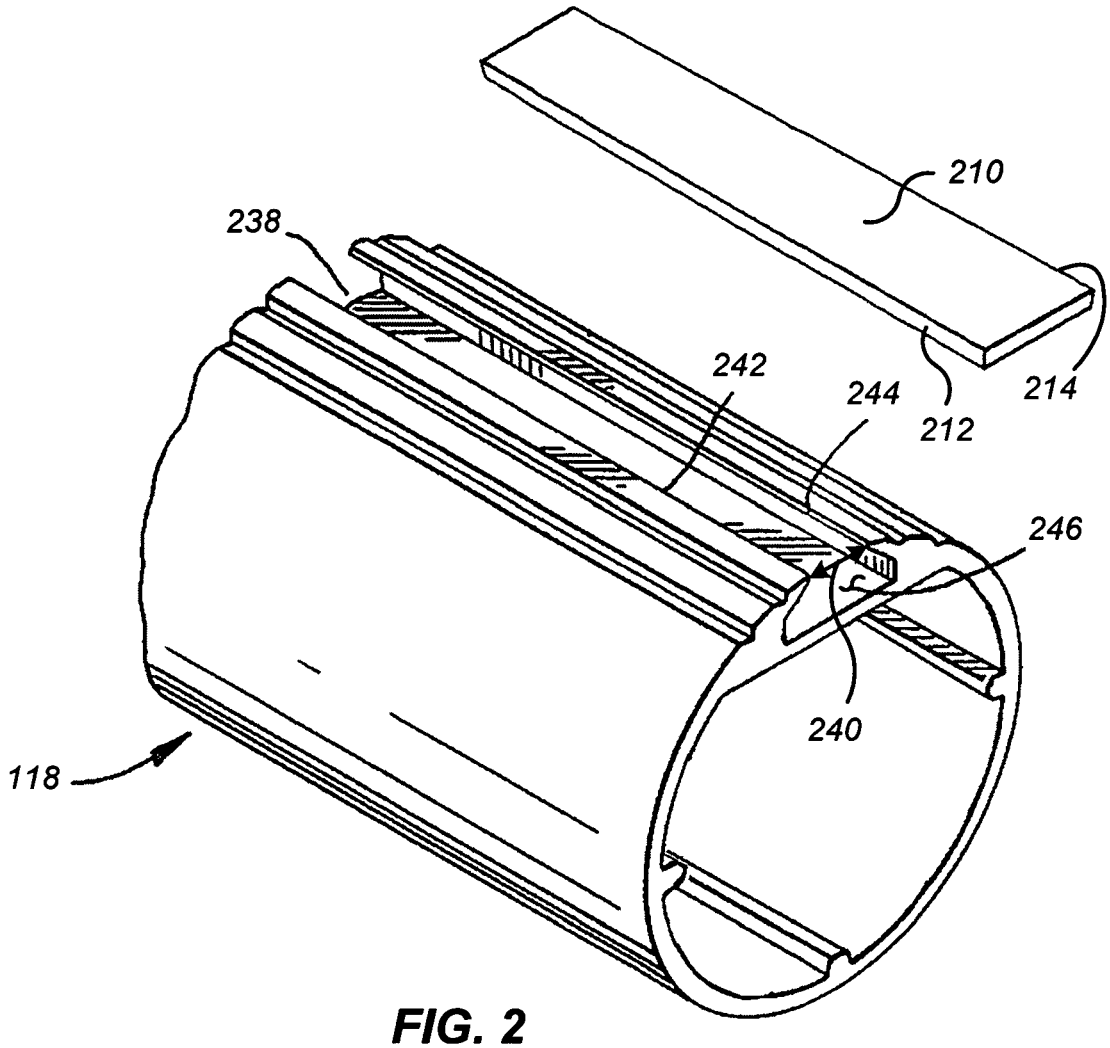
FIG. 2 is a perspective cross section of a locking strip and a frame member of the frame of FIG. 1 in accordance with aspects of the invention.

The frame members 114-120 may be identical. Hence, the frame member 118 will be described in detail, as exemplary embodiment. FIG. 2 is a perspective cross section of a locking strip 210 and the frame member 118 of the frame 100 of FIG. 1 in accordance with aspects of the invention. The frame member 118 may be fabricated with a longitudinally extending locking strip groove 238 disposed along a periphery of the frame member 118. In various embodiments fabrication comprises extrusion, machining, casting, and/or the like. The frame member 118 is illustrated in FIG. 2 as generally circular. In various embodiments, the cross section of the frame member 118 may be circular, rectangular, square, hexagonal, or other regular or non-regular polygonal figure, having 3, 4, 5, 6, 7, 8, or more sides. In various embodiments, the cross section of the frame member 118 may describe a curve that is circular, oval, or an arbitrarily complex curve. The frame members 114-120 may be configured in various combinations of curved cross sections and/or polygonal cross sections.

The locking strip groove 238 includes a gap 240 extending between an upper edge 242 and an upper edge 244 at the periphery of the frame member 118. The bottom of the locking strip groove 238 may be defined by a base surface 246. The frame member 118 is configured to cooperate the locking strip 210 for securing the screen fabric 112. The locking strip 210 may be an elongated strip of stiff material configured to flex. The locking strip may be made of semi-rigid, flexible materials including plastic, aluminum, fiber glass, rubber, and/or the like. The locking strip 210 comprises a first edge 212 and a second edge 214. In some embodiments, the locking strip 210 may be symmetrical such that the first edge 212 is about the same in cross section as the second edge 214. A locking strip thickness d4 may be selected to advantage. A length of the locking strip 210 may be determined according to a length of the frame member 118. The length of the locking strip 210 extends at least a portion of the length of the frame member 118.

Figure 3:
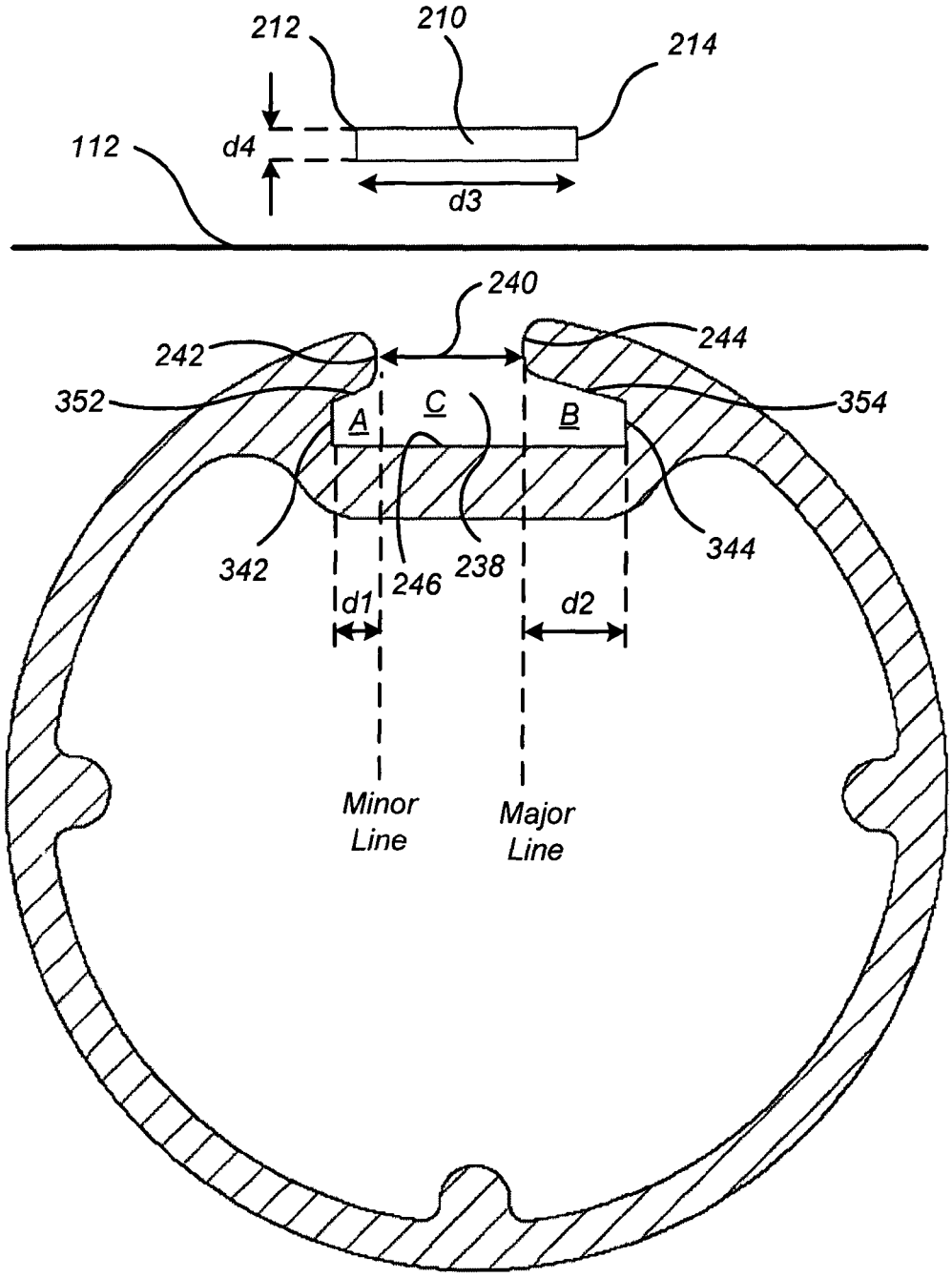
FIG. 3 illustrates one embodiment of a cross section view along a line a-a' of a frame member of the frame of FIG. 1 and the locking strip of FIG. 2.

FIG. 3 illustrates one embodiment of a cross section view along a line a-a' of the frame member 118 of the frame 100 of FIG. 1, and the locking strip 210 of FIG. 2. The frame member 118 includes the locking strip 210 and the locking strip groove 238. The locking strip groove 238 may be further defined by the upper edge 242, the upper edge 244, an upper surface 352, an upper surface 354, a groove wall 342, a groove wall 344, and the base surface 246. The locking strip groove 238 may be divided for discussion purposes into a central groove C, a minor side groove A, and a major side groove B. As can be seen in FIG. 3, the central groove C, the minor side groove A, and the major side groove B may form an inverted "T". The minor side groove A includes the portion of the locking strip groove 238 between a minor line (illustrated in FIG. 3 as extending from the upper edge 242 and about normal to the base surface 246) and the groove wall 342. The minor side groove A may be defined by the upper surface 352, the groove wall 342, the minor line, and a portion of the base surface 246 between the minor line and the groove wall 342.

The major side groove B includes the portion of the locking strip groove 238 between a major line (illustrated in FIG. 3 as extending from the upper edge 244 and about normal to the base surface 246), and the groove wall 344. The major side groove B may be defined by the upper surface 354, the groove wall 344, the major line, and a portion of the base surface 246 between the major line and the groove wall 344. The central groove C includes the portion of the locking strip groove 238 between the minor line and the major line and may be defined by the minor line, the major line, the upper edge 242, the upper edge 244, the gap 240 and a portion of the base surface between the minor line, the major line. The minor side groove A has a minor depth d1. The major side groove B has a major depth d2. The major depth d2 is greater than the minor depth d1. FIG. 3 illustrates the minor side groove A on the left and the major side groove B on the right. However, it will be appreciated by persons having ordinary skill in the art that the minor side groove A may be on the right and the major side groove B may be on the left.

A locking strip width d3 may be defined as the distance from the first edge 212 to the second edge 214. In various embodiments, the locking strip width d3 may be greater than about the distance from the groove wall 342 to the upper edge 244, less than about the distance from the groove wall 344 to the upper edge 242, greater than about the distance from the groove wall 342 to the major line, and/or less than about the distance from the groove wall 344 to the minor line. The screen fabric 112 may be disposed between the locking strip 210 and the locking strip groove 238.

Figure 4:
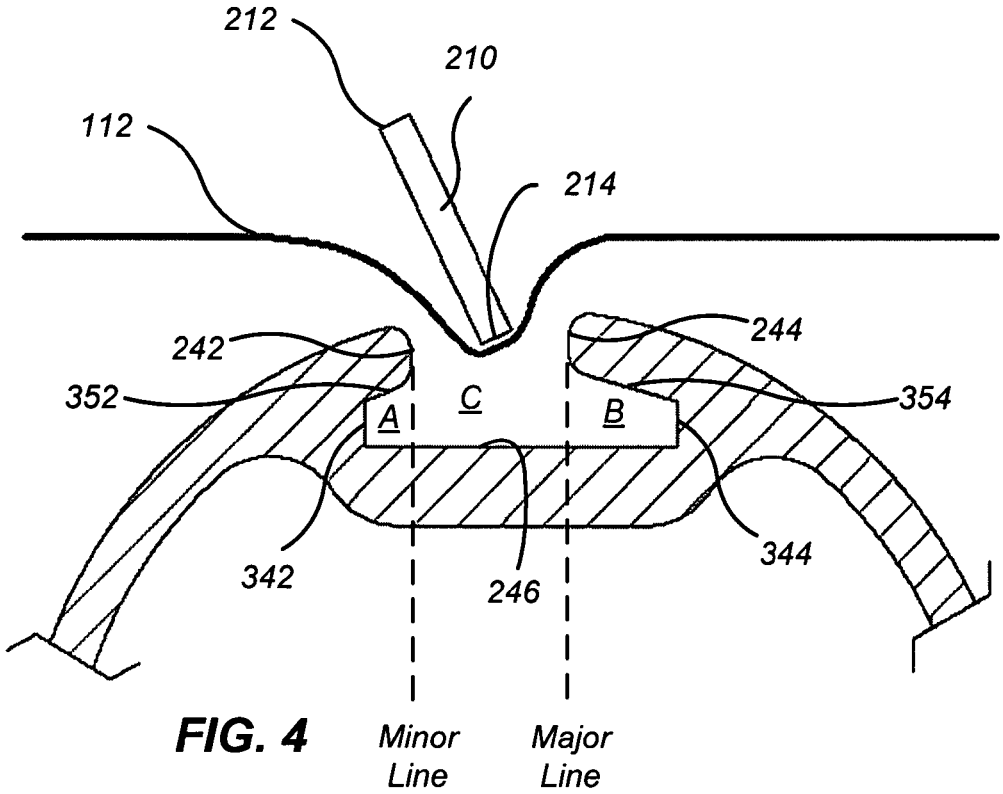
FIGS. 4-8 illustrate insertion of the locking strip into a locking strip groove, in accordance with aspects of the invention.

FIGS. 4-8 illustrate insertion of the locking strip 210 into the locking strip groove 238, in accordance with aspects of the invention. The locking strip 210 may be inserted through the gap 240 into the locking strip groove 238 to lock the screen fabric 112 within the locking strip groove 238 without sliding the locking strip 210 longitudinally along the locking strip groove 238. Referring to FIG. 4, the locking strip 210 may be tilted about a longitudinal roll axis (an axis extending into the page) to bring the second edge 214 to bear against the screen fabric 112 disposed between the locking strip 210 and the locking strip groove 238. The screen fabric 112 folds between the locking strip 210 and the locking strip groove 238, and the locking strip 210 urges a portion of the screen fabric 112 through the gap 240 and into the central groove C of the locking strip groove 238.

Figure 5:
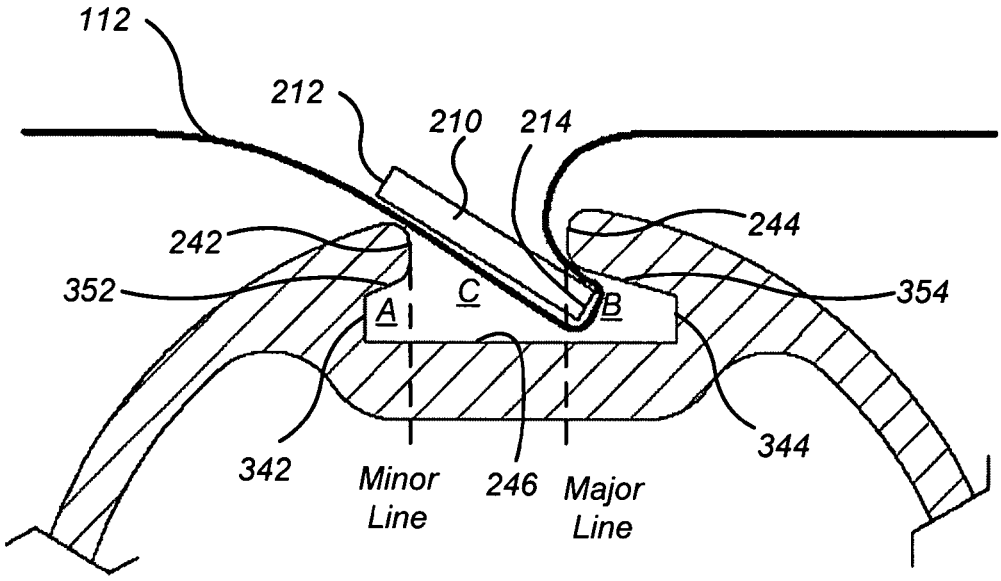
Figure 6:
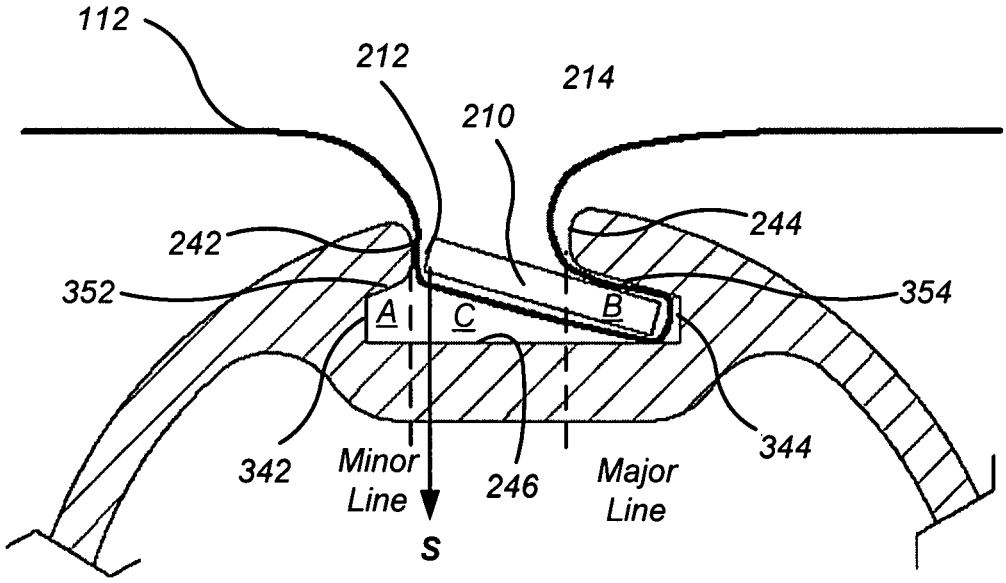
Figure 7:
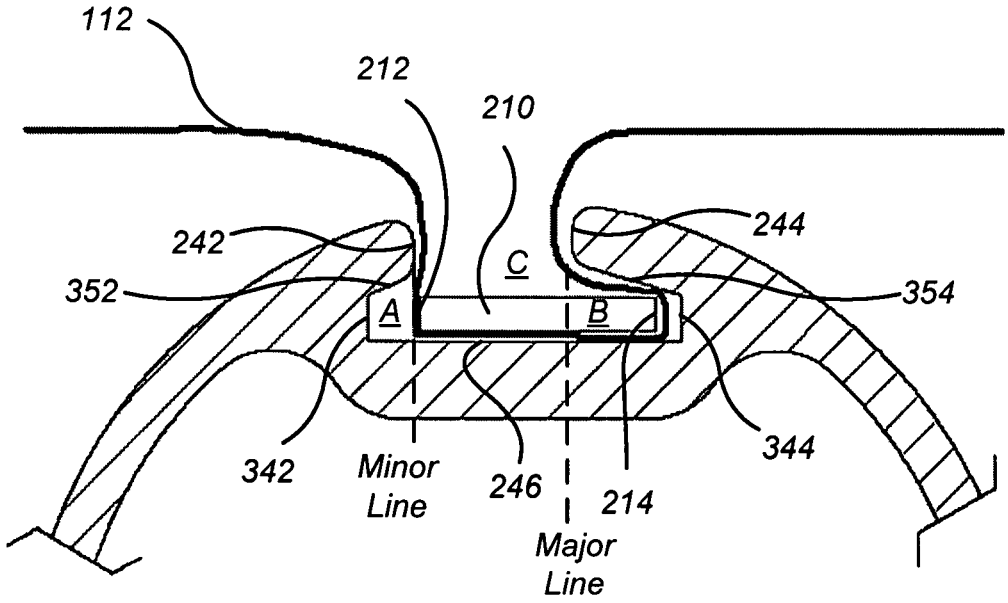

Referring to FIG. 5, the second edge 214 of the locking strip 210 may be further urged into the major side groove B, pushing additional screen fabric 112 into the locking strip groove 238. Referring to FIG. 6, the second edge 214 of the locking strip 210 may be further urged into the major side groove B until the first edge 212 clears the upper edge 242 of the locking strip groove 238 sufficiently to enter the central groove C. Additional screen fabric 112 may be folded around the locking strip and/or pushed into the locking strip groove 238, between the locking strip 210 and the locking strip groove 238. A downward force "S" on the first edge 212 of the locking strip 210 may urge the first edge 212 past the upper edge 242, enabling rotation of the locking strip 210 into a position, illustrated in FIG. 7, inside the locking strip groove 238 about parallel with the base surface 246. In some embodiments, the locking strip 210 is sized to form an interference fit between such that the first edge 212 bears on the upper edge 242 during insertion into the locking strip groove 238.

Figure 8:
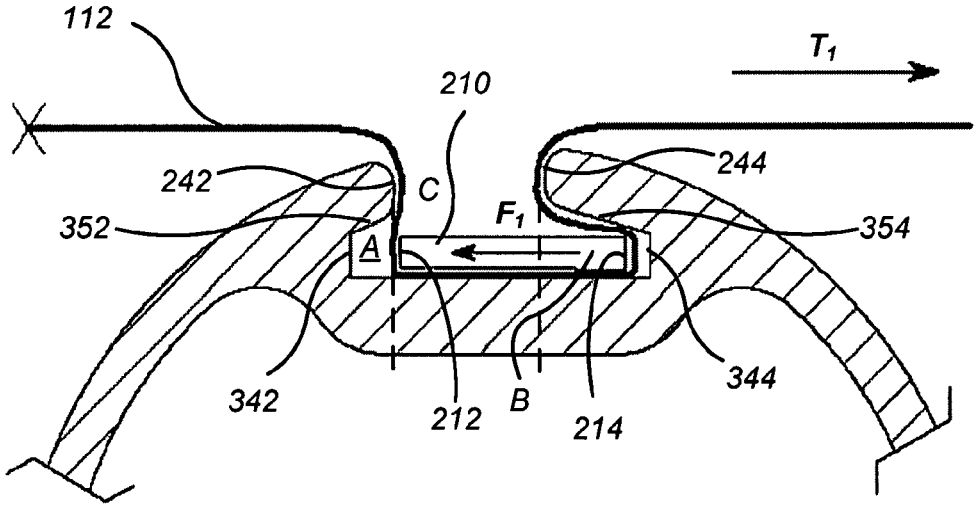

Referring to FIG. 8, a tension T1 may be applied to the screen fabric 112. The tension T1 is illustrated as being applied to the right. The tension T1 urges the screen fabric 112 against the upper edge 244 and the upper surface 354, resulting in applying a force F1 on the locking strip 210, in the opposite direction (to the left) of the tension T1. The force F1 urges the locking strip 210 to the left toward the groove wall 342 and into the minor side groove A.

Figure 9A:
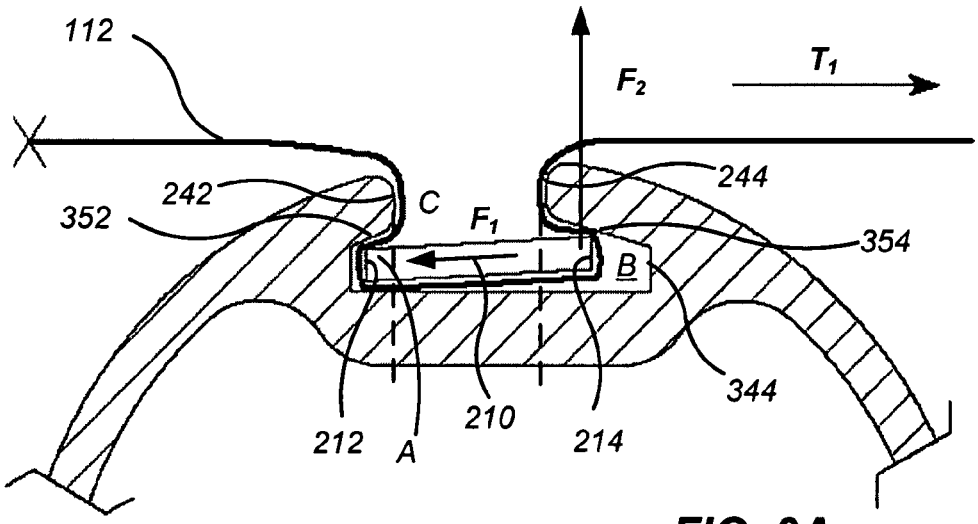
FIG. 9A illustrates the locking strip in a locked position for securing the screen fabric in the locking strip groove, in accordance with aspects of the invention.

FIG. 9A illustrates the locking strip 210 in a locked position for the securing screen fabric 112 in the locking strip groove 238, in accordance with aspects of the invention. It may be appreciated that the force F1 on the locking strip 210 may pinch and/or bind the screen fabric 112 between the first edge 212 and the groove wall 342 and/or the upper surface 352. The screen fabric 112 may be constrained from sliding around the locking strip 210 and through the locking strip groove 238 by the pinching and/or binding of the screen fabric 112. An increase in the tension T1 on the screen fabric 112 may apply additional force F1 to the locking strip, increasing the pinching and/or binding of the screen fabric 112. The pinching and/or binding of the screen fabric 112 may tend to provide a holding force on the screen fabric 112 against the tension T1.

It may be further appreciated that the tension T1 may also apply a lifting force F2 to the second edge 214 of the locking strip 210. Since the minor depth d1 is less than the major depth d2, the locking strip 210 cannot rotate clear of the upper edge 244. Thus, the lifting force F2 may also pinch and/or bind the screen fabric 112 between the second edge 214 and the upper surface 354, providing additional holding force on the screen fabric 112 against the tension T1.

In various embodiments, the locking strip 210 may be adapted to twist about the roll axis and/or flex along the longitudinal dimension during insertion, permitting short portions of the locking strip 210 to be inserted into the locking strip groove 238. By progressively working along the length of the locking strip 210 from one end of the locking strip groove 238 to the opposite end, the entire locking strip 210 may be inserted into the locking strip groove 238 a little at a time without sliding the locking strip 210 longitudinally along the locking strip groove 238.

Figure 9B:
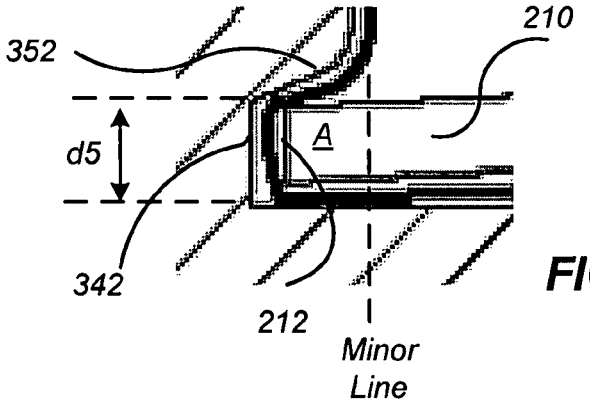
FIG. 9B illustrates details of the locking strip groove of FIG. 9A, in accordance with aspects of the invention.

FIG. 9B illustrates details of the locking strip groove 238 of FIG. 9A. The groove wall 342 may have a wall height d5 and the upper surface 352 may form a sloping angle upward toward the gap 240. In some embodiments, the locking strip thickness d4 may be sized to be greater than the wall height d5. In such embodiments, the force F1 may wedge the first edge 212 of the locking strip 210 between the upper surface 352 and the base surface 246, providing additional pinching and/or binding of the screen fabric 112. In some embodiments the locking strip thickness d4 plus a thickness of two layers of the screen fabric 112 may be sized to be greater than the wall height d5.

Figure 10:
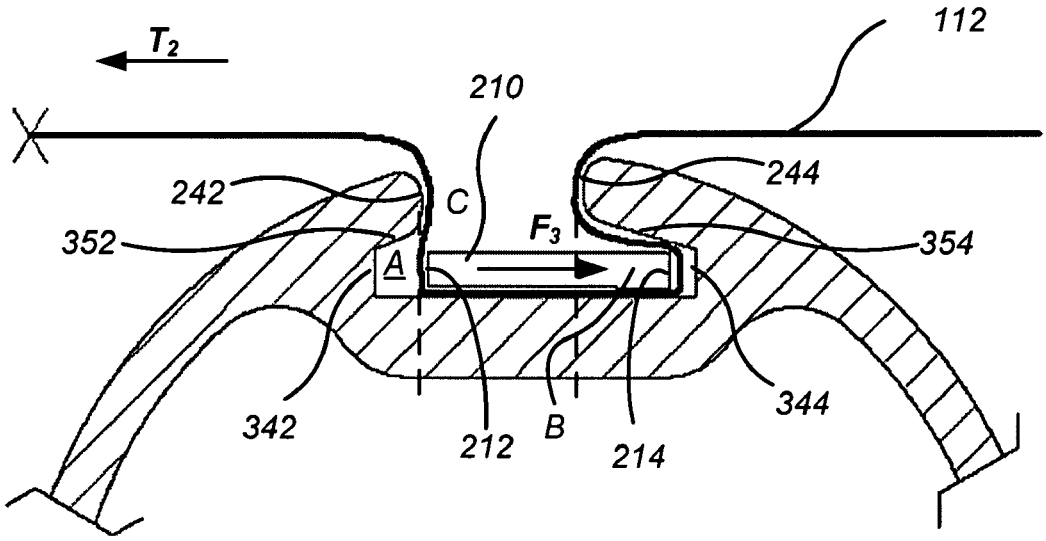
FIGS. 10-12 illustrate removal of the locking strip from the locking strip groove, in accordance with aspects of the invention.
Figure 11:
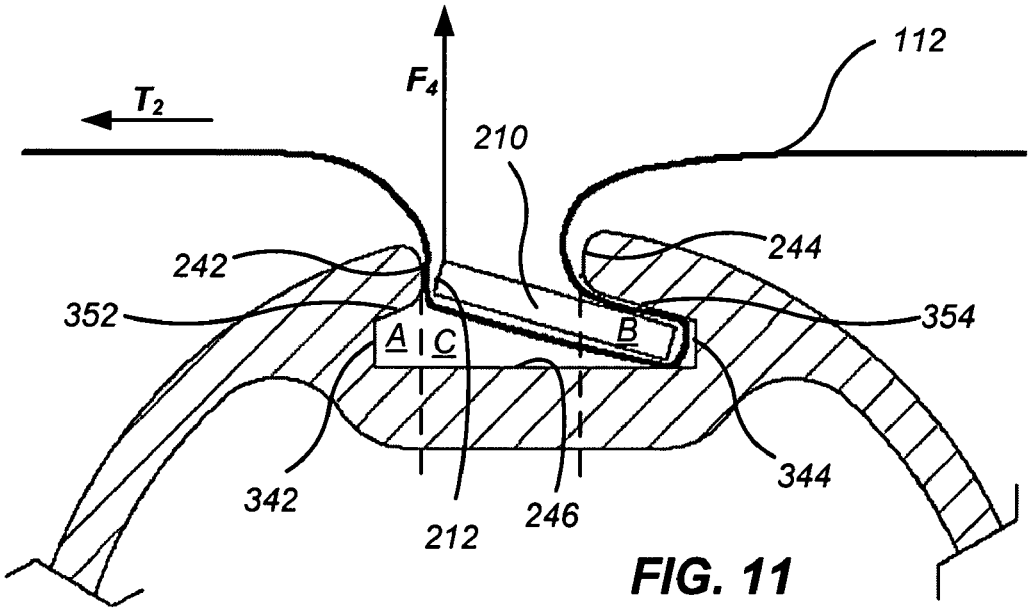
Figure 12:
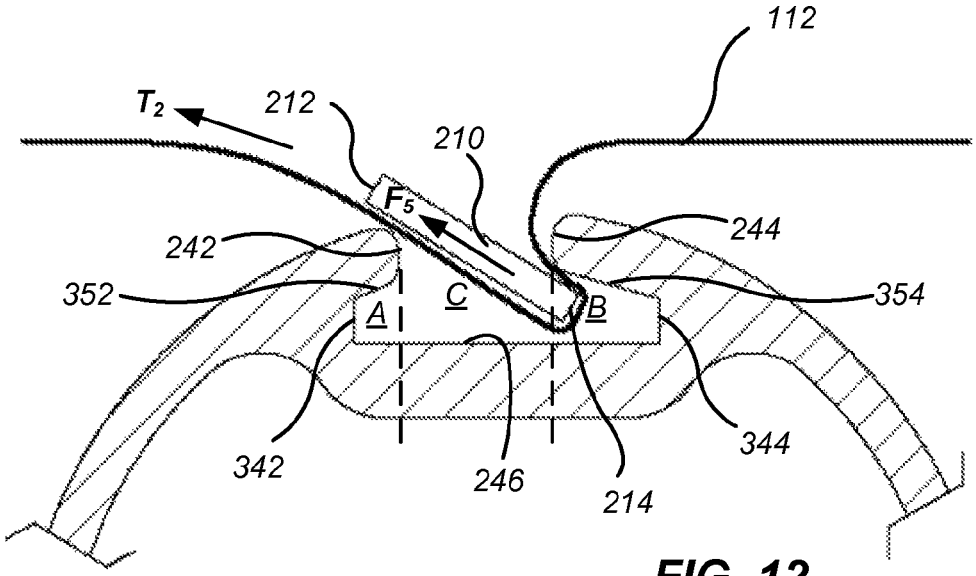

FIGS. 10-12 illustrate removal of the locking strip 210 from the locking strip groove 238, in accordance with aspects of the invention. Referring to FIG. 10, a tension T2 may be applied to the screen fabric 112. The tension T2 is illustrated in FIG. 10 as being applied to the left. Under the tension T2, the screen fabric 112 bears on the upper edge 242 and the first edge 212 of the locking strip 210, exerting a resultant force F3 on the locking strip 210. The force F3 may be exerted in the opposite direction as the tension T2. The force F3 is illustrated in FIG. 10 as being exerted to the right. The locking strip 210 may be urged (to the right) away from the minor side groove A and into the major side groove B by the force F3. However, the major depth d2 is greater than the minor depth d1. Thus, as the second edge 214 of the locking strip 210 approaches the groove wall 344 in the major side groove B, the first edge 212 may be in a position to rotate clear of the upper edge 242.

Referring to FIG. 11, as the first edge 212 approaches a position below the upper edge 242, the tension T2 may exert an additional upward force F4 on the first edge 212. The upward force F4 may rotate the locking strip 210 clear of the upper edge 242.

Referring to FIG. 12, as the first edge 212 clears the upper edge 242, the tension T2 may exert another force F5 (up and to the left) on the locking strip 210 enabling extraction of the locking strip 210 from the locking strip groove 238.

Figure 13:
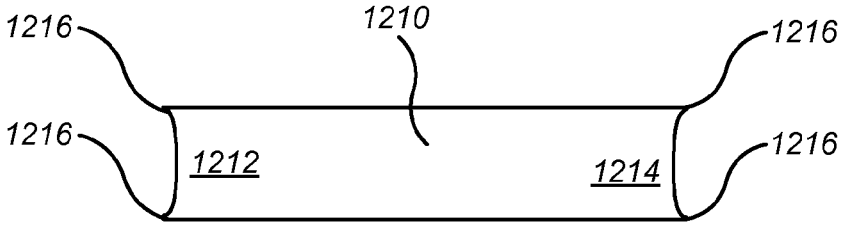
FIG. 13 illustrates a cross section of one exemplary embodiment of a locking strip.
Figure 14:
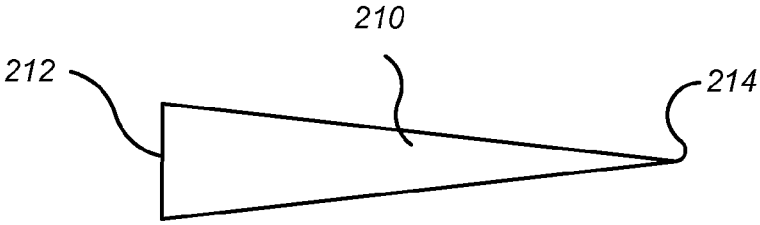
FIG. 14 illustrates a cross section of an exemplary embodiment of a triangular locking strip.

FIG. 13 illustrates a cross section of one exemplary embodiment of a locking strip 1210. The locking strip 1210 comprises a first edge 1212 and a second edge 1214. The first edge 1212 and the second edge 1214 include two points 1216 configured to enhance the binding of the screen fabric 112 between locking strip 1210 and the locking strip groove 238. FIG. 14 illustrates a triangular cross section of an exemplary embodiment of a locking strip 210. The locking strip 210 of FIG. 14 differs from the locking strip 210 of FIGS. 2-13 in that the locking strip 210 of FIG. 14 has a triangular cross section instead of a rectangular cross section.

Several embodiments are specifically illustrated and/or described herein. However, it will be appreciated that modifications and variations are covered by the above teachings and within the scope of the appended claims without departing from the spirit and intended scope thereof. For example, the upper surface 354 may be configured to dispose the locking strip in a position to clear the upper edge 242. For example, the frame 100 may comprise one, two, three, four, five, or more frame members 118. For example the frame members may be disposed in a non-planer arrangement. For example, the cross section of the locking strip 210 is illustrated as rectangular, however various embodiments of the locking strip 210 include triangular, five sided, six sided, and/or the like. In various embodiments, the cross section of the locking strip 210 includes simple and/or complex curves. For example, the upper surfaces 352 and 354 may include grooves and/or ridges for enhancing a gripping of the screen fabric 112. For example, the base surface 246 may include grooves and/or ridges for enhancing the gripping of the screen fabric 112. For example, the groove walls 342 and 344 may include grooves and/or ridges for enhancing a gripping of the screen fabric 112. For example, the locking strip 210 may include grooves and/or ridges for enhancing the gripping of the screen fabric 112. For example the first edge 212 and/or second edge 214 of the locking strip 210 may include one or more points for enhancing the gripping of the screen fabric 112. For example the first edge 212 and/or second edge 214 of the locking strip 210 may include one or more grooves for enhancing the gripping of the screen fabric 112. For example the first edge 212 and/or second edge 214 of the locking strip 210 may include one or more ridges for enhancing the gripping of the screen fabric 112.

The embodiments discussed herein are illustrative. As these embodiments are described with reference to illustrations, various modifications or adaptations of the methods and/or specific structures described may become apparent to persons of ordinary skill in the art. All such modifications, adaptations, or variations that rely upon the teachings of the embodiments, and through which these teachings have advanced the art, are considered to be within the spirit and scope of the present application. Hence, these descriptions and drawings should not be considered in a limiting sense, as it is understood that the present application is in no way limited to only the embodiments illustrated.

What is claimed is:

1. A frame for stretching screen fabric, the frame comprising:

a locking strip; and a frame member including a locking strip groove extending at least a portion of a length of the frame member, the locking strip groove including a central groove configured to receive the locking strip, a minor side groove having a minor depth and a groove wall, and a major side groove distal the central groove, the major side groove having a major depth greater than the minor depth of the minor side groove, a thickness of the locking strip plus a thickness of two layers of screen fabric being greater than a height of the groove wall.

2. The frame of claim 1, wherein a cross section of the locking strip groove is about the shape of a "T".

3. The frame of claim 1, wherein a width of the locking strip is less than about a sum of the major depth of the major side groove plus a width of the central groove.

4. The frame of claim 1 wherein a width of the locking strip is greater than about the sum of the minor depth of the minor side groove plus a width of the central groove.

5. The frame of claim 1 wherein the locking strip includes one or more longitudinal ridges.

6. The frame of claim 1, wherein the locking strip has a rectangular cross section.

7. The frame of claim 1, wherein the locking strip has a triangular cross section.

8. The frame of claim 1 further comprising a screen printing apparatus.

9. The frame of claim 1, wherein the locking strip is an elongated strip of stiff material configured to flex along the longitudinal dimension.

10. The frame of claim 1, wherein the frame member is rectangular.

11. A screen fabric tensioning member including a locking strip groove cross section comprising:

a central portion configured to receive a screen fabric and a locking strip;

a minor side groove having a sloping upper surface and a base surface, the minor side groove configured to bind a first portion of the screen fabric between the sloping upper surface of the minor side groove and an upper surface of the locking strip and to bind a second portion of the screen fabric between the base surface of the minor side groove and a lower surface of the locking strip; and a major side groove having a major depth, the major depth plus a width of the central groove greater than a width of the locking strip.

12. The tensioning member of claim 11 wherein the locking strip groove cross section is about the shape of an inverted "T".

13. The tensioning member of claim 11 further comprising a screen printing apparatus.

14. The tensioning member of claim 11, wherein the tensioning member is hollow.

15. A method for tensioning a screen fabric comprising:

folding the screen fabric around a locking strip;

inserting a first edge of the locking strip into a longitudinal groove of a screen tensioning member and urging the folded screen fabric into the longitudinal groove using the first edge of the locking strip;

pushing the folded screen fabric into a major side groove having a major depth using the first edge of the locking strip;

rotating the locking strip to an orientation about parallel with a base surface of the longitudinal groove;

applying a tension to the screen fabric, the tension configured to urge a second edge of the locking strip into a minor side groove having an upper sloping surface, the width of the locking strip less than the major depth plus a width of the of a central groove; and wedging the locking strip and folded screen fabric between the upper sloping surface and a portion of the base surface within the minor side groove.

16. The method of claim 15, further comprising applying the tension to the screen fabric by rotating the screen tensioning member.

17. The method of claim 15, further comprising removing the screen fabric from the longitudinal groove in the screen tensioning member by applying a counter tension to the screen fabric in a direction about opposite the tension.

* * * * *